US007020975B2

(12) United States Patent
Ernst et al.

(10) Patent No.: US 7,020,975 B2
(45) Date of Patent: Apr. 4, 2006

(54) PLAQUE WITH ALIGNMENT AND ATTACHMENT SYSTEM FOR SYMBOLS

(75) Inventors: Sharon K. Ernst, Montague, MI (US); Lee S. Brown, Montague, MI (US); Jamie S. Hossink, Muskegon, MI (US)

(73) Assignee: Whitehall Products, LLC, Montague, MI (US)

( * ) Notice: Subject to any disclaimer, the term of this patent is extended or adjusted under 35 U.S.C. 154(b) by 0 days.

(21) Appl. No.: 10/627,139

(22) Filed: Jul. 25, 2003

(65) Prior Publication Data

US 2005/0016009 A1 Jan. 27, 2005

(51) Int. Cl.
*G09F 7/12* (2006.01)

(52) U.S. Cl. ..... 33/613; 33/562; 40/594

(58) Field of Classification Search ..... 33/613, 33/562, 563, 564, 566, 645; 40/594, 595
See application file for complete search history.

(56) References Cited

U.S. PATENT DOCUMENTS

| | | | | |
|---|---|---|---|---|
| 159,725 | A | 2/1875 | Warren | |
| 1,481,956 | A | 1/1924 | Carufel | |
| 1,633,703 | A | 6/1927 | Kaji | |
| 1,781,258 | A | 11/1930 | Walker | |
| 2,387,966 | A * | 10/1945 | Evans | 33/653 |
| 2,451,775 | A | 10/1948 | Roher | |
| 2,970,043 | A * | 1/1961 | Serafin | 283/117 |
| 3,137,978 | A | 6/1964 | Incantalupo | |
| 3,242,577 | A | 3/1966 | Murphy | |
| 3,315,387 | A | 4/1967 | Heuser | |
| 3,440,746 | A | 4/1969 | Richards | |
| 3,461,583 | A | 8/1969 | Buck | |
| 3,526,986 | A | 9/1970 | Dempnock et al. | |
| 3,584,385 | A | 6/1971 | Booth | |
| 3,690,013 | A * | 9/1972 | Leptrone et al. | 40/584 |

(Continued)

FOREIGN PATENT DOCUMENTS

| | | |
|---|---|---|
| GB | 2244165 | 11/1991 |

(Continued)

OTHER PUBLICATIONS

Directions for using 11" Mailbox Address Frame with 3" numbers (sold separately) included with the sale of the 11" Mailbox Address Frame by Cole Consumer Products more than one year prior to the filing date of the present application, 1 page.

(Continued)

*Primary Examiner*—Diego Gutierrez
*Assistant Examiner*—Amy R. Cohen
(74) *Attorney, Agent, or Firm*—Price, Heneveld, Cooper, DeWitt & Litton, LLP

(57) ABSTRACT

An assembly for placing alphanumeric symbols on a frame having a face. The assembly comprises a template and at least one alphanumeric locator. The template is adapted to fit against the face of the frame in accurate position thereon, with the template having an opening therethrough and a scale thereon. The least one alphanumeric locator fits within the opening of the template and is properly located in position by aligning a portion of the at least one alphanumeric locator with the scale of the template. The at least one alphanumeric locator has an aperture therethrough, each aperture having a perimeter corresponding to a periphery of at least one alphanumeric symbol. The alphanumeric symbol can be accurately positioned on the face of the frame by inserting the alphanumeric symbol through the aperture having the corresponding perimeter and adhering the alphanumeric symbol to the face of the frame.

50 Claims, 3 Drawing Sheets

U.S. PATENT DOCUMENTS

| | | | | | |
|---|---|---|---|---|---|
| 3,956,838 | A | * | 5/1976 | Gerrish | 40/799 |
| 4,015,352 | A | * | 4/1977 | Prange | 40/594 |
| 4,125,658 | A | | 11/1978 | Miles | |
| 4,172,331 | A | * | 10/1979 | Becker | 40/591 |
| 4,274,459 | A | * | 6/1981 | Galajda | 144/144.51 |
| 4,339,886 | A | | 7/1982 | Griffiths et al. | |
| 4,344,994 | A | | 8/1982 | Batty et al. | |
| 4,443,949 | A | * | 4/1984 | Newton | 33/613 |
| 4,480,399 | A | | 11/1984 | Teti, Jr. | |
| 4,852,483 | A | | 8/1989 | Bussard | |
| 4,916,826 | A | | 4/1990 | McKeown | |
| 4,972,598 | A | * | 11/1990 | Charters, Jr. | 33/564 |
| 5,027,523 | A | * | 7/1991 | MacLeod | 33/564 |
| 5,226,993 | A | | 7/1993 | Tukakoshi et al. | |
| 5,918,398 | A | * | 7/1999 | Stanley et al. | 40/594 |
| 6,129,969 | A | | 10/2000 | Pyenburg et al. | |
| 6,142,071 | A | | 11/2000 | Fexer | |
| 6,338,214 | B1 | * | 1/2002 | Held | 40/620 |
| 6,385,840 | B1 | | 5/2002 | Scarfia | |
| 6,524,412 | B1 | * | 2/2003 | Smith | 156/71 |
| 6,820,546 | B1 | * | 11/2004 | Wynne | 101/129 |
| 6,829,990 | B1 | * | 12/2004 | Cochran et al. | 101/127.1 |

FOREIGN PATENT DOCUMENTS

| | | |
|---|---|---|
| GB | 2250369 | 6/1992 |

OTHER PUBLICATIONS

Directions for using Stencils sold in a package by Hy-Ko Products Company more than one year prior to the filing date of the present application, 1 page.

* cited by examiner

PLAQUE WITH ALIGNMENT AND ATTACHMENT SYSTEM FOR SYMBOLS

BACKGROUND OF THE INVENTION

The present invention relates to signs or plaques, and in particular to an attachment system assembly for accurately making signs.

Signs and plaques are used to convey information. Signs and plaques typically have alphanumeric characters located thereon to convey the information. The appearance of a typeface on the sign is affected not only by the appearance of individual characters, but also by the way the characters are spaced within a character string. The appearance of some letters or numbers can vary by the distance between adjacent characters. Accordingly, a system of spacing alphanumeric characters called kerning has been developed to improve the appearance of signs. Kerning is the adjustment of space between pairs of letters or numbers to make them more visually appealing. Kerning is normally applied to individual letter or number pair in headlines or other large type. The default spacing between some characters leaves gaps that can be adjusted by kerning the two letters or numbers to achieve a more visually balanced appearance. Some commonly kerned pairs include Wa, To and Ya. Kerning can sometimes be difficult to implement with the naked eye as letters or numbers are placed onto the signs or plaques. Accordingly, an assembly providing for easy placement of letters or numbers on a sign or plaque is desired.

SUMMARY OF THE INVENTION

One aspect of the present invention is to provide a sign system assembly comprising a frame having a face, a template, at least one alphanumeric locator and an alphanumeric symbol for each alphanumeric locator. The template is adapted to fit against the face in accurate position thereon. The template has an opening therethrough and a scale thereon. The at least one alphanumeric locator is configured to fit within the opening of the template and be properly located in position by aligning a portion of the at least one alphanumeric locator with the scale of the template. The at least one alphanumeric locator has an aperture therethrough. Each alphanumeric symbol has an adhesive backing. Each aperture in the alphanumeric locator has a perimeter corresponding to a periphery of at least one alphanumeric symbol. The alphanumeric symbol can be accurately positioned on the face of the frame by inserting the alphanumeric symbol through the aperture having the corresponding perimeter and adhering the alphanumeric symbol to the face of the frame.

Another aspect of the present invention is to provide a sign making system assembly for a frame having a face. The sign making system comprises a template, at least one alphanumeric locator and an alphanumeric symbol for each alphanumeric locator. The template is adapted to fit against the face in accurate position thereon. The template has an opening therethrough and a scale thereon. The at least one alphanumeric locator is configured to fit within the opening of the template and be properly located in position by aligning a portion of the at least one alphanumeric locator with the scale of the template. The at least one alphanumeric locator has an aperture therethrough. Each alphanumeric symbol has an adhesive backing. Each aperture of the alphanumeric locator has a perimeter corresponding to a periphery of at least one alphanumeric symbol. The alphanumeric symbol can be accurately positioned on the face of the frame by inserting the alphanumeric symbol through the aperture having the corresponding perimeter and connecting the alphanumeric symbol to the face of the frame.

Yet another aspect of the present invention is to provide a sign making system assembly for placing alphanumeric symbols on a frame having a face. The assembly comprises a template and at least one alphanumeric locator. The template is adapted to fit against the face of the frame in accurate position thereon. The template has an opening therethrough and a scale thereon. The at least one alphanumeric locator is configured to fit within the opening of the template and be properly located in position by aligning a portion of the at least one alphanumeric locator with the scale of the template. The at least one alphanumeric locator has an aperture therethrough, with each aperture having a perimeter configured to correspond to a periphery of at least one alphanumeric symbol. The alphanumeric symbol can be accurately positioned on the face of the frame by inserting the alphanumeric symbol through the aperture having the corresponding perimeter and connecting the alphanumeric symbol to the face of the frame.

In yet another aspect of the present invention, a method of accurately making a sign is provided. The method comprises providing a frame having a face, providing a template with a scale thereon, providing an opening through the template and placing the template in position against the face of the frame. The method further comprises providing at least one alphanumeric locator, with the at least one alphanumeric locator having an aperture therethrough. The method also comprises locating the at least one alphanumeric locator within the opening of the template and aligning a portion of the at least one alphanumeric locator with the scale of the template to accurately position the at least one alphanumeric locator. Furthermore, the method comprises providing an alphanumeric symbol for each alphanumeric locator, with each alphanumeric symbol having a periphery corresponding to a perimeter of the aperture of one of the at least one alphanumeric locator. Moreover, the method comprises inserting the alphanumeric symbol through the aperture in one of the at least one alphanumeric locator and connecting each alphanumeric symbol to the face of the frame.

Another aspect of the present invention is to provide a method of accurately making a sign with a frame having a face. The method comprises providing a template with a scale thereon, providing an opening through the template, placing the template in position against the face of the frame, and providing at least one alphanumeric locator, with the at least one alphanumeric locator having an aperture therethrough. The method further comprises locating the at least one alphanumeric locator within the opening of the template and aligning a portion of the at least one alphanumeric locator with the scale of the template to accurately position the at least one alphanumeric locator. The method also comprises providing an alphanumeric symbol for each alphanumeric locator, with each alphanumeric symbol having a periphery corresponding to a perimeter of the aperture of one of the at least one alphanumeric locator. Furthermore, the method comprises inserting the alphanumeric symbol through the aperture in one of the at least one alphanumeric locator and connecting each alphanumeric symbol to the face of the frame.

Yet another aspect of the present invention is to provide a method of accurately aligning at least one alphanumeric symbol on a face of a frame to make a sign. The method comprises providing a template with a scale thereon, providing an opening through the template, placing the template in position against the face of the frame, and providing at least one alphanumeric locator, with the at least one alphanumeric locator having an aperture therethrough. The method further comprises locating the at least one alphanumeric locator within the opening of the template and aligning a portion of the at least one alphanumeric locator with the scale of the template to accurately position the at least one alphanumeric locator. The method also comprises providing each aperture with a perimeter corresponding to a periphery of at least one alphanumeric symbol, inserting the alphanumeric symbol through the aperture in one of the at least one alphanumeric locator, and connecting the at least one alphanumeric symbol to the face of the frame.

These and other features, advantages, and objects of the present invention will be further understood and appreciated by those skilled in the art by reference to the following specification, claims and appended drawings.

DETAILED DESCRIPTION OF THE PREFERRED EMBODIMENTS

Figure 1:
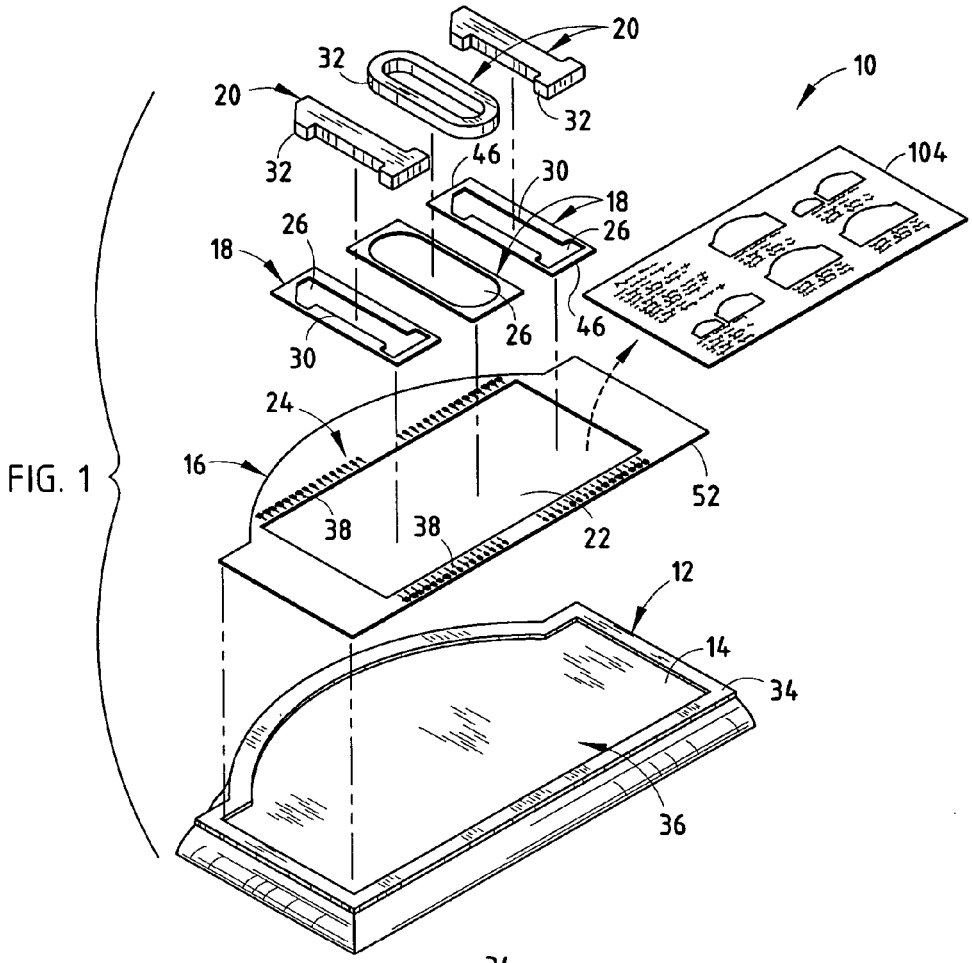
FIG. 1 is an exploded perspective view of a sign system assembly of the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a sign system assembly embodying the present invention. In the illustrated example, the sign system assembly 10 comprises a frame 12 having a face 14, a template 16, at least one alphanumeric locator 18 and an alphanumeric symbol 20 for each alphanumeric locator 18. The template 16 is adapted to fit over the face 14 and be fixed in position thereon. The template 16 has an opening 22 therethrough and a scale 24 thereon. The at least one alphanumeric locator 18 is configured to fit within the opening 22 of the template 16 and be properly located in position by aligning a portion of the at least one alphanumeric locator 18 with the scale 24 of the template 18. The at least one alphanumeric locator 18 has an aperture 26 therethrough. Each alphanumeric symbol 20 has an adhesive backing. Each aperture 26 has a perimeter 30 corresponding to a periphery 32 of at least one alphanumeric symbol 20. The alphanumeric symbol 20 can be accurately positioned on the face 14 of the frame 12 by inserting the alphanumeric symbol 20 through the aperture 26 having the corresponding perimeter 30 and adhering the alphanumeric symbol 20 to the face 14 of the frame 12.

In the illustrated example, the frame 12 (FIGS. 1–3) is configured to be placed on a vertical wall. The frame 12 includes the face 14 configured to accept the alphanumeric symbol 20 thereon. The frame 12 preferably includes a ridge 34 extending from the face 14, with the ridge 34 defining an interior space 36. The ridge 34 could be continuous or discontinuous. The ridge 34 preferably defines an outside border of the face 14. However, in alternative embodiments, it is contemplated that the frame 12 could not have the ridge 34, that the frame 12 could be affixed to any surface or that the frame 12 could be freestanding. The illustrated alphanumeric symbols 20 (FIGS. 1 and 2) are configured to be affixed to the face 14 of the frame 12. The alphanumeric symbols can be affixed to the face 14 of the frame 12 using an adhesive, placing a fastener through the alphanumeric symbols 20 and the face 14, or in other similar manners. The alphanumeric symbols 20 represent any letter in any language or any number.

The illustrated template 16 is placed on the face 14 of the frame 12 (FIG. 3) and is used to properly align the alphanumeric symbols 20 on the face 14. The template 16 includes the opening 22 therethrough and the scale 24 thereon. The opening 22 is preferably centrally located in the template 16 and preferably includes at least two parallel sides 38. In the illustrated example, the opening 22 is a rectangle. The scale 24 is located adjacent two opposite sides of the at least two parallel sides 38. The scale 24 is preferably located above and below the horizontal opposite sides 38 of the opening 22. The scale 24 comprises a plurality of marks 40 along each of the two opposite sides 38 signifying a distance from a center point 42 of the scale 24. Each of the marks 40 preferably includes a number 44, with identical numbers 44 being located equidistant from the center point 42 of the scale 24. For example, the first number 44 on each side of the center point 42 of the scale 24 both above and below the opening 22 is "1", the second number 44 on each side of the of the center point 42 of the scale 24 both above and below the opening 22 is "2", etc. (see FIG. 3).

In the illustrated example, the alphanumeric locators 18 are used in combination with the template 16 to properly align the alphanumeric symbols 20 on the face 14 of the frame 12. The alphanumeric locators 20 preferably include at least two parallel edges 46, with the at least two parallel edges 46 of the alphanumeric locators 18 having an edge distance therebetween approximately equal to a side distance between the two opposite sides 38 of the opening 22 in the template 16. In the illustrated example, the alphanumeric locators 18 are rectangular. Each aperture 26 through the alphanumeric locator 18 has the perimeter 30 corresponding to the periphery 32 of at least one alphanumeric symbol 20. Therefore, the alphanumeric symbols 20 can fit through the aperture 26.

Figure 2:
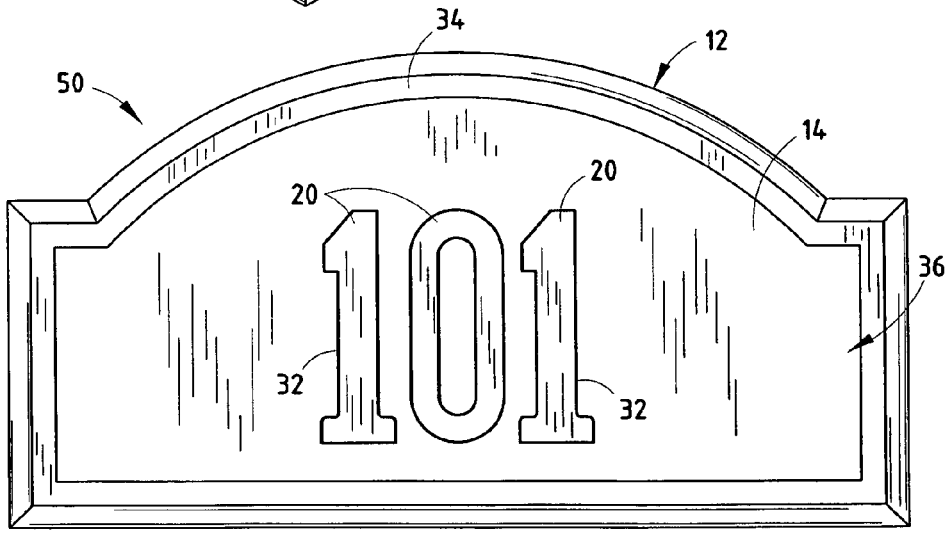
FIG. 2 is a front view of a sign.

The illustrated sign system assembly 10 is used to accurately make a sign 50 comprising the frame 12 and the alphanumeric symbols 20 (FIG. 2). First, the template 16 is fixed in position over the face 14 of the frame 12. Preferably, the template 16 includes a boundary 52 having the same configuration as the ridge 34 extending from the face 14 of the frame 12. Therefore, the template 16 can be fixed in position by placing the template 16 within the interior space 36 such that the boundary 52 of the template 16 abuts against the ridge 34. However, it is contemplated that the template 16 could be fixed to the face 14 of the frame 12 in other manners. The alphanumeric symbols 20 are also selected.

Furthermore, the alphanumeric locators 18 having apertures 26 corresponding to the selected alphanumeric symbols 20 are selected.

Figure 3:
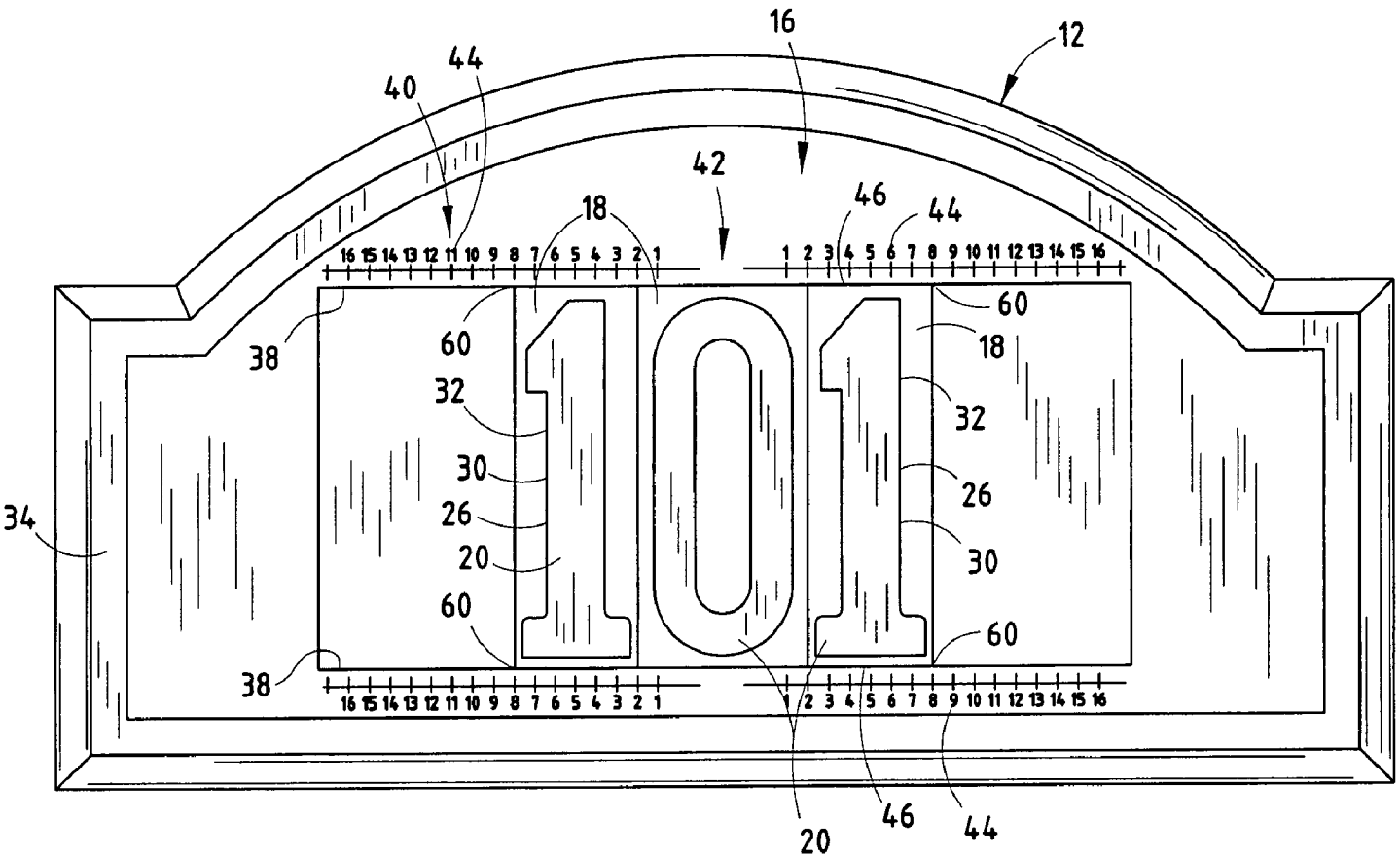
FIG. 3 is a front view of the sign system assembly of the present invention.

The alphanumeric locators 18 are then placed within the opening 22 in the template 16. The alphanumeric locators 18 are preferably positioned by aligning four outer corners 60 of at least one alphanumeric locator 18 with marks 40 equidistant from the center point 42 of the scale 24. If one alphanumeric symbol 20 is to be placed on the frame 12, the alphanumeric locator 18 having the aperture 26 corresponding to the alphanumeric symbol 20 is positioned within the opening 22 in the template 16 such that the four outer corners 60 of the alphanumeric locator 18 are aligned with identical marks 40 equidistant from the center point 42 of the scale 24 on the template 16. For example, the four outer corners 60 of the alphanumeric locator 18 could be aligned with the mark 40 having the number 44 "2". If a plurality of alphanumeric symbols 20 are to be placed on the face 14 of the frame 12, two outer corners 60 of each outer positioned alphanumeric locator 18 are aligned with identical marks 40 equidistant from the center point 42 of the scale 24 on the template 16. For example, the four outer corners 60 of the outer positioned alphanumeric locators 18 could be aligned with the mark 40 having the number 44 "8" (see FIG. 3). Preferably, the alphanumeric locators 18 abut a side of an adjacent alphanumeric locator 18 when they are positioned in the opening as illustrated in FIG. 3. However, the alphanumeric locators 18 could be spaced from adjacent alphanumeric locators 18 and aligned using the scale 24 on the template. The alphanumeric symbols 20 are then inserted through the corresponding apertures 26 in the alphanumeric locator 18 and affixed into position on the face 14 of the frame 12. Preferably, the alphanumeric symbols 20 include double sided tape on a rear side thereof for adhering the alphanumeric symbols 20 to the face 14 of the frame 12. It is contemplated that the alphanumeric symbols 20 could be adhered to the face 14 of the frame 12 in other manners.

Accordingly, with the template 16 and the alphanumeric locators 18 of the sign system assembly 10, the alphanumeric symbols 20 can be properly positioned on the face 14 of the frame 12. Furthermore, the alphanumeric symbols 20 can be properly positioned apart from each other using kerning because of the spacing of the apertures 26 in the alphanumeric locators 18, and therefore the spacing of the alphanumeric symbols 20 once they are affixed to the frame 12. Therefore, the sign system assembly 10 allows a user of the sign system assembly 10 to easily and accurately make an aesthetically pleasing sign 50 using kerning.

Figure 5:
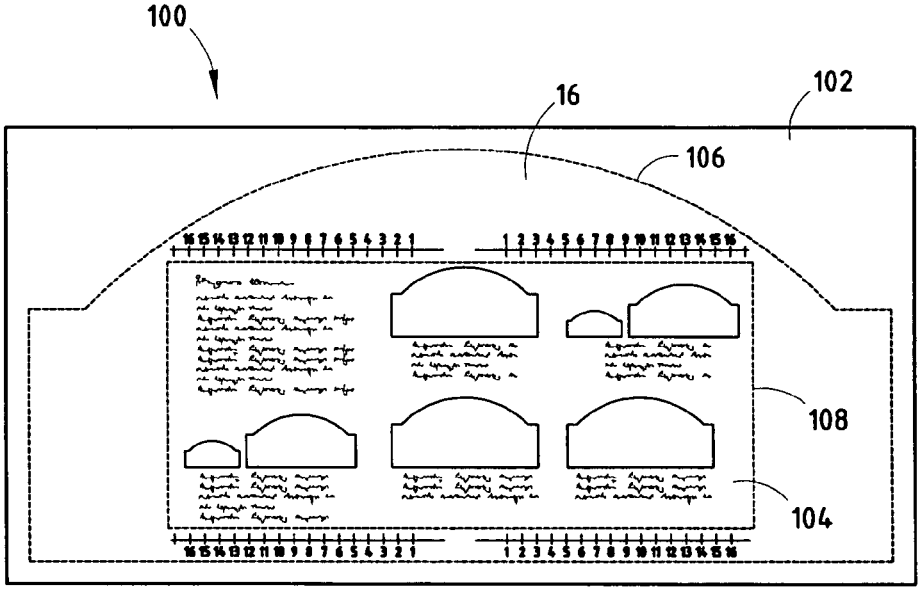
FIG. 5 is a front view of a panel of the present invention.

In a preferred embodiment of the present invention, the template 16 is an element of a panel 100 (FIG. 5). The panel 100 preferably includes an outer margin 102, the template 16 and a guide 104. The guide 104 preferably includes directions for using the sign system assembly 10. The template 16 is removably connected to the outer margin 102 and the guide 104 is removably connected to the template 16. Preferably, the panel 100 includes first perforations 106 defining a first interface between the outer margin 102 and the template 16 and second perforations 108 defining a second interface between the template 16 and the guide 104, with the second perforations 108 defining the opening 22 in the template 16. Therefore, the opening 22 is formed by removing the guide 104 (see FIG. 1).

Figure 4:
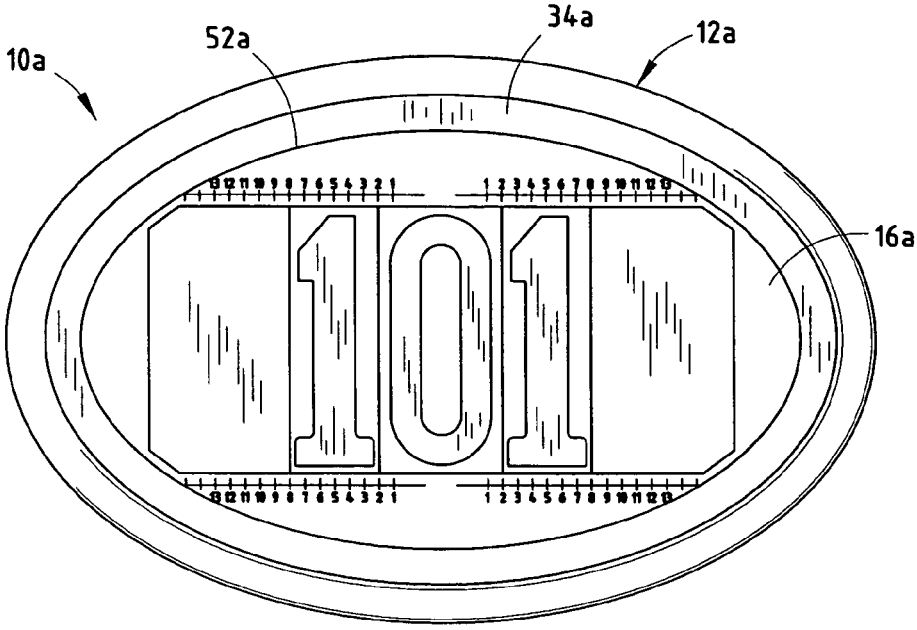
FIG. 4 is a front view of a second embodiment of the sign system assembly of the present invention.

The reference number 10*a* (FIG. 4) generally designates a second embodiment of the present invention, comprising a second embodiment of the sign system assembly. The sign system assembly 10*a* is essentially similar to the previously described sign system assembly 10 in many ways, similar parts appearing in FIG. 3 and FIG. 4, respectfully, are represented by the same, corresponding reference numeral, except for the suffix "a" in the numerals of the latter. The illustrated sign system assembly 10*a* is identical to the previously described sign system assembly 10, except that the ridge 34*a* extending from the face of the frame 12*a* is oval. Therefore, the interior space defined by the ridge 34*a* is oval. Accordingly, the outer boundary 52*a* of the template 16*a* is oval.

In the forgoing description, it will be readily appreciated by those skilled in the art that modifications may be made to the invention without departing from the concepts disclosed herein. For example, it is contemplated that the ridge 34, and therefore the outer boundary 52 of the template 16, could have any geometric configuration. Such modifications are to be considered as included in the following claims, unless these claims by their language expressly state otherwise.

We claim:

1. A sign system assembly comprising:

a frame having a face;

a template adapted to fit against the face in an accurate position thereon, the template having an opening therethrough and a scale thereon;

at least one movable alphanumeric locator configured to fit within the opening of the template and be properly located in position by aligning a portion of the at least one alphanumeric locator with the scale of the template, the at least one alphanumeric locator having an aperture therethrough; and an alphanumeric symbol for each alphanumeric locator, each alphanumeric symbol having an adhesive backing;

wherein each aperture has a perimeter corresponding to a periphery of at least one alphanumeric symbol; and wherein the alphanumeric symbol can be accurately positioned on the face of the frame by inserting the alphanumeric symbol through the aperture having the corresponding perimeter and adhering the alphanumeric symbol to the face of the frame.

2. The sign system assembly of claim 1, wherein:

the frame includes a ridge extending from the face of the frame; and the template is adapted to abut against the ridge to be fixed in position on the face of the frame.

3. The sign system assembly of claim 2, wherein:

the ridge defines a closed border.

4. The sign system assembly of claim 3, wherein;

the ridge defines an oval interior space; and the template includes an oval boundary corresponding to the oval interior space defined by the ridge of the frame.

5. The sign system assembly of claim 1, wherein:

the opening in the template includes at least two parallel sides.

6. The sign system assembly of claim 5, wherein:

the scale is located adjacent two opposite sides of the at least two parallel sides.

7. The sign system assembly of claim 6, wherein:

the scale comprises a plurality of marks along each of the two opposite sides signifying a distance from a center point of the scale.

8. The sign system assembly of claim 6, wherein:

the at least one alphanumeric locator includes at least two parallel edges, the at least two parallel edges of the at least one alphanumeric locator having an edge distance therebetween approximately equal to a side distance between the two opposite sides of the opening in the template, whereby the at least one alphanumeric locator can be easily and accurately placed into position within the opening in the template.

9. The sign system assembly of claim 1, wherein:

the at least one alphanumeric locator comprises a plurality of alphanumeric locators.

10. The sign system assembly of claim 1, wherein:

the alphanumeric symbol includes double sided tape on a rear side thereof defining the adhesive backing.

11. The sign system assembly of claim 1, wherein:

the at least one alphanumeric locator comprises at least two alphanumeric locators; and the at least two alphanumeric locators are configured to fit within the opening of the template and be properly located in position by aligning the portion of each of the at least two alphanumeric locators with the scale of the template.

12. The sign system assembly of claim 1, wherein:

the at least one alphanumeric locator can slide within the opening of the template to align the portion of the at least one alphanumeric locator with the scale of the template.

13. A sign system assembly comprising:

a frame having a face;

a template adapted to fit against, the face in an accurate position thereon, the template having an opening therethrough and a scale thereon;

at least one alphanumeric locator configured to fit within the opening of the template and be properly located in position by aligning a portion of the at least one alphanumeric locator with the scale of the template, the at least one alphanumeric locator having an aperture therethrough; and an alphanumeric symbol for each alphanumeric locator, each alphanumeric symbol having an adhesive backing;

wherein each aperture has a perimeter corresponding to a periphery of at least one alphanumeric symbol; and wherein the alphanumeric symbol can be accurately positioned on the face of the frame by inserting the alphanumeric symbol through the aperture having the corresponding perimeter and adhering the alphanumeric symbol to the face of the frame; and a panel comprising an outer margin, the template and a guide;

wherein the template is removably connected to the outer margin and the guide is removably connected to the template.

14. The sign system assembly of claim 13, wherein:

the panel includes first perforations defining a first interface between the outer margin and the template and second perforations defining a second interface between the template and the guide, the second perforations defining the opening in the template whereby the opening is formed by removing the guide.

15. A sign making system assembly for a frame having a face comprising:

a template adapted to fit against the face in an accurate position thereon, the template having an opening therethrough and a scale thereon;

at least one movable alphanumeric locator configured to fit within the opening of the template and be properly located in position by aligning a portion of the at least one alphanumeric locator with the scale of the template, the at least one alphanumeric locator having an aperture therethrough; and an alphanumeric symbol for each alphanumeric locator, each alphanumeric symbol having an adhesive backing;

wherein each aperture has a perimeter corresponding to a periphery of at least one alphanumeric symbol; and wherein the alphanumeric symbol can be accurately positioned on the face of the frame by inserting the alphanumeric symbol through the aperture having the corresponding perimeter and connecting the alphanumeric symbol to the face of the frame.

16. The sign system assembly of claim 15, wherein:

the template is adapted to abut against a ridge extending from the face of the frame to be fixed in position on the face of the frame.

17. The sign system assembly of claim 16, wherein;

the template includes an oval boundary configured to correspond to an oval interior space defined by the ridge of the frame.

18. The sign system assembly of claim 15, wherein:

the opening in the template includes at least two parallel sides.

19. The sign system assembly of claim 18, wherein:

the scale is located adjacent two opposite sides of the at least two parallel sides.

20. The sign system assembly of claim 19, wherein:

the scale comprises a plurality of marks along each of the two opposite sides signifying a distance from a center point of the scale.

21. The sign system assembly of claim 19, wherein:

the at least one alphanumeric locator includes at least two parallel edges, the at least two parallel edges of the at least one alphanumeric locator having an edge distance therebetween approximately equal to a side distance between the two opposite sides of the opening in the template, whereby the at least one alphanumeric locator can be easily and accurately placed into position within the opening in the template.

22. The sign system assembly of claim 15, wherein:

the at least one alphanumeric locator comprises a plurality of alphanumeric locators.

23. The sign system assembly of claim 15, wherein:

the alphanumeric symbol for each alphanumeric locator includes double sided tape on a rear side thereof defining the adhesive backing.

24. The sign making system of claim 15, wherein:

the at least one alphanumeric locator comprises at least two alphanumeric locators; and the at least two alphanumeric locators are configured to fit within the opening of the template and be properly located in position by aligning the portion of each of the at least two alphanumeric locators with the scale of the template.

25. The sign system assembly of claim 15, wherein:

the at least one alphanumeric locator can slide within the opening of the template to align the portion of the at least one alphanumeric locator with the scale of the template.

26. A sign making system assembly for a frame having a face comprising:

a template adapted to fit against the face in an accurate position thereon, the template having an opening therethrough and a scale thereon;

at least one alphanumeric locator configured to fit within the opening of the template and be properly located in position by aligning a portion of the at least one alphanumeric locator with the scale of the template, the at least one alphanumeric locator having an aperture therethrough; and an alphanumeric symbol for each alphanumeric locator, each alphanumeric symbol having an adhesive backing;

wherein each aperture has a perimeter corresponding to a periphery of at least one alphanumeric symbol; and wherein the alphanumeric symbol can be accurately positioned on the face of the frame by inserting the alphanumeric symbol through the aperture having the corresponding perimeter and connecting the alphanumeric symbol to the face of the frame; and a panel comprising an outer margin, the template and a guide;

wherein the template is removably connected to the outer margin and the guide is removably connected to the template.

27. The sign system assembly of claim 26, wherein:

the panel includes first perforations defining a first interface between the outer margin and the template and second perforations defining a second interface between the template and the guide, the second perforations defining the opening in the template whereby the opening is formed by removing the guide.

28. A sign making system assembly for placing alphanumeric symbols on a frame having a face, the assembly comprising:

a template adapted to fit against the face of the frame in an accurate position thereon, the template having an opening therethrough and a scale thereon; and at least one movable alphanumeric locator configured to fit within the opening of the template and be properly located in position by aligning a portion of the at least one alphanumeric locator with the scale of the template, the at least one alphanumeric locator having an aperture therethrough, each aperture having a perimeter configured to correspond to a periphery of at least one alphanumeric symbol;

wherein the alphanumeric symbol can be accurately positioned on the face of the frame by inserting the alphanumeric symbol through the aperture having the corresponding perimeter and connecting the alphanumeric symbol to the face of the frame.

29. The sign making system assembly of claim 28, wherein:

the template is adapted to abut against a ridge extending from the face of the frame to be fixed in position on the face of the frame.

30. The sign system assembly of claim 29, wherein;

the template includes an oval boundary configured to correspond to an oval interior space defined by the ridge of the frame.

31. The sign system assembly of claim 28, wherein:

the opening in the template includes at least two parallel sides.

32. The sign system assembly of claim 31, wherein:

the scale is located adjacent two opposite sides of the at least two parallel sides.

33. The sign system assembly of claim 32, wherein:

the scale comprises a plurality of marks along each of the two opposite sides signifying a distance from a center point of the scale.

34. The sign system assembly of claim 32, wherein:

the at least one alphanumeric locator includes at least two parallel edges, the at least two parallel edges of the at least one alphanumeric locator having an edge distance therebetween approximately equal to a side distance between the two opposite sides of the opening in the template, whereby the at least one alphanumeric locator can be easily and accurately placed into position within the opening in the template.

35. The sign system assembly of claim 28, wherein:

the at least one alphanumeric locator comprises a plurality of alphanumeric locators.

36. The sign making system assembly of claim 28, wherein:

the at least one alphanumeric locator comprises at least two alphanumeric locators; and the at least two alphanumeric locators are configured to fit within the opening of the template and be properly located in position by aligning the portion of each of the at least two alphanumeric locators with the scale of the template.

37. The sign making system assembly of claim 28, wherein:

the at least one alphanumeric locator can slide within the opening of the template to align the portion of the at least one alphanumeric locator with the scale of the template.

38. A sign making system assembly for placing alphanumeric symbols on a frame having a face, the assembly comprising:

a template adapted to fit against the face of the frame in an accurate position thereon, the template having an opening therethrough and a scale thereon; and at least one alphanumeric locator configured to fit within the opening of the template and be properly located in position by aligning a portion of the at least one alphanumeric locator with the scale of the template, the at least one alphanumeric locator having an aperture therethrough, each aperture having a perimeter configured to correspond to a periphery of at least one alphanumeric symbol;

wherein the alphanumeric symbol can be accurately positioned on the face of the frame by inserting the alphanumeric symbol through the aperture having the corresponding perimeter and connecting the alphanumeric symbol to the face of the frame; and a panel comprising an outer margin, the template and a guide;

wherein the template is removably connected to the outer margin and the guide is removably connected to the template.

39. The sign system assembly of claim 38, wherein:

the panel includes first perforations defining a first interface between the outer margin and the template and second perforations defining a second interface between the template and the guide, the second perforations defining the opening in the template whereby the opening is formed by removing the guide.

40. A method of accurately making a sign comprising:

providing a frame having a face;

providing a template with a scale thereon;

providing an opening through the template;

placing the template in position against the face of the frame;

providing at least one movable alphanumeric locator, the at least one alphanumeric locator having an aperture therethrough;

locating the at least one alphanumeric locator within the opening of the template and aligning a portion of the at least one alphanumeric locator with the scale of the template to accurately position the at least one alphanumeric locator;

providing an alphanumeric symbol for each alphanumeric locator, each alphanumeric symbol having a periphery corresponding to a perimeter of the aperture of one of the at least one alphanumeric locator;

inserting the alphanumeric symbol through the aperture in one of the at least one alphanumeric locator; and connecting each alphanumeric symbol to the face of the frame.

41. The method of accurately making a sign of claim 40, further including:

adhering double sided tape to the alphanumeric symbol.

42. The method of claim 40, wherein:

locating at least one alphanumeric locator within the opening of the template comprises locating at least two alphanumeric locators within the opening of the template.

43. The method of claim 40, wherein:

aligning the portion of the at least one alphanumeric locator with the scale of the template comprises sliding the at least one alphanumeric locator within the opening of the template.

44. A method of accurately making a sign with a frame having a face, the method comprising:

providing a template with a scale thereon;

providing an opening through the template;

placing the template in position against the face of the frame;

providing at least one movable alphanumeric locator, the at least one alphanumeric locator having an aperture therethrough;

locating the at least one alphanumeric locator within the opening of the template and aligning a portion of the at least one alphanumeric locator with the scale of the template to accurately position the at least one alphanumeric locator;

providing an alphanumeric symbol for each alphanumeric locator, each alphanumeric symbol having a periphery corresponding to a perimeter of the aperture of one of the at least one alphanumeric locator;

inserting the alphanumeric symbol through the aperture in one of the at least one alphanumeric locator; and connecting each alphanumeric symbol to the face of the frame.

45. The method of accurately making a sign of claim 44, further including:

adhering double sided tape to the alphanumeric symbol.

46. The method of claim 44, wherein:

locating at least one alphanumeric locator within the opening of the template comprises locating at least two alphanumeric locators within the opening of the template.

47. The method of claim 44, wherein:

aligning the portion of the at least one alphanumeric locator with the scale of the template comprises sliding the at least one alphanumeric locator within the opening of the template.

48. A method of accurately aligning at least one alphanumeric symbol on a face of a frame to make a sign, the method comprising:

providing a template with a scale thereon;

providing an opening through the template;

placing the template in position against the face of the frame;

providing at least one movable alphanumeric locator, the at least one alphanumeric locator having an aperture therethrough;

locating the at least one alphanumeric locator within the opening of the template and aligning a portion of the at least one alphanumeric locator with the scale of the template to accurately position the at least one alphanumeric locator;

providing each aperture with a perimeter corresponding to a periphery of at least one alphanumeric symbol;

inserting the alphanumeric symbol through the aperture in one of the at least one alphanumeric locator; and connecting the at least one alphanumeric symbol to the face of the frame.

49. The method of claim 48, wherein:

locating at least one alphanumeric locator within the opening of the template comprises locating at least two alphanumeric locators within the opening of the template.

50. The method of claim 48, wherein:

aligning the portion of the at least one alphanumeric locator with the scale of the template comprises sliding the at least one alphanumeric locator within the opening of the template.

* * * * *